United States Patent [19]

Myers et al.

[11] 4,242,930

[45] Jan. 6, 1981

[54] TORQUE CONTROLLED CLAMP STICK ADAPTER

[75] Inventors: Franklin D. Myers; Marvin D. McKelvy, both of Centralia, Mo.

[73] Assignee: A. B. Chance Company, Centralia, Mo.

[21] Appl. No.: 34,196

[22] Filed: Apr. 27, 1979

[51] Int. Cl.[3] ..... B25B 23/142

[52] U.S. Cl. ..... 81/474; 81/53.1; 64/29; 294/19 R

[58] Field of Search ..... 294/19 R, 20, 21; 64/29; 81/52.4 R, 52.4 A, 53.1; 192/56 R

[56] References Cited

U.S. PATENT DOCUMENTS

| | | | |
|---|---|---|---|
| 2,316,428 | 4/1943 | Heinrich | 81/53.1 |
| 2,514,063 | 7/1950 | Hubbard | 294/19 R |
| 2,613,516 | 10/1952 | Rees | 64/29 |
| 2,732,746 | 1/1956 | Livermont | 81/52.4 R |
| 3,667,250 | 6/1972 | Schnepel | 81/52.4 R X |

*Primary Examiner*—Johnny D. Cherry

*Attorney, Agent, or Firm*—Schmidt, Johnson, Hovey & Williams

[57] ABSTRACT

A torque-limiting adapter for an elongated, insulative hot line clamp stick is provided which allows completely safe, accurate take-up of workpieces only to desired torque levels. The adapter preferably includes an elongated, tubular, axially rotatable head removably mounted onto the work end of a conventional clamp stick and housing a torque-limiting device; the input of the device is connected to the existing rotatable clamp stick, while the torque output of the device is connected to a manipulative tool, such as a pivotal hook. The tool is coupled to the head such that they rotate in unison until the desired torque level is reached, and is further coupled for axial shifting into and out of the head for safety purposes.

11 Claims, 7 Drawing Figures

TORQUE CONTROLLED CLAMP STICK ADAPTER

BACKGROUND OF THE INVENTION

1. Field of the Invention

The present invention is concerned with a lineman's clamp stick equipped with torque-limiting means such that a workpiece can be tightened with the stick only to a desired torque level. More particularly, it is concerned with such a torque-limiting clamp stick wherein, in especially preferred forms, a removable, torque-limiting adapter is mounted onto the normal work end of an otherwise conventional clamp stick.

2. Description of the Prior Art

Elongated, insulative clamp sticks have long been used by linemen for their work in and around energized electrical lines or equipment. For example, certain types of clamp sticks are designed to mount and dismount electrical transmission and distribution equipment and, for this purpose, are provided with manually shiftable operating machanism for axially rotating the tool from a safe, remote position. In addition, such clamp sticks are normally provided with mechanism for axially shifting the hook into and out of the insulative body of the clamp stick for reasons of safety and ease of operations.

In many tightening operations where a clamp stick is conventionally employed, it would be desirable to have some limit to the amount of torque which can be applied to a workpiece. That is to say, it has been known for linemen to over-tighten connectors and thus deform or damage the equipment being mounted or an electrical line. On the other hand, the connectors must be tightened sufficiently to avoid high resistance connections which can lead to catstrophic failures. Of course, conventional torque wrenches cannot be used to measure applied torque in this context because this would subject the linemen to the extreme peril of electrical shock. Hence, the prior and unsatisfactory technique has been for the lineman to "guess" at the appropriate torque.

U.S. Pat. No. 2,514,063 discloses one type of clamp stick in widespread use today, and this patent is incorporated herein by reference.

SUMMARY OF THE INVENTION

The problems outlined above are solved by the present invention which provides a clamp stick including a torque-limiting device which transmits torque to an operating tool only up to a predetermined maximum torque. In preferred forms, a removable adapter for a conventional clamp stick is provided which includes an elongated, tubular, axially rotatable head with an operating assembly located at least partially within the head. The latter includes a torque-limiting device presenting a torque input and a torque output; the torque input to the device is operatively connected to the rotatable clamp stick, whereas the torque output of the device is connected to a hook or other similar manipulative tool. Thus, the adapter can be mounted onto the normal work end of a conventional clamp stick in order to provide the desired torque-limiting feature, and without in any way detracting from the usefulness of the clamp stick.

In other preferred forms, the adapter head is coupled to the manipulative tool for axial rotation of the head and tool in unison before the torque limit of the device is reached. When such limit is achieved, the device slips so that no further torque is transmitted to the workpiece. Further, the operating assembly of the adapter is preferably axially shiftable relative to the head so that the manipulative tool can be shifted into and out of the extreme end of the head for reasons of safety. This duplicates the normal axial and rotational shifting of a manipulative tool in conventional clamp sticks.

DESCRIPTION OF THE PREFERRED EMBODIMENT

Figure 1:
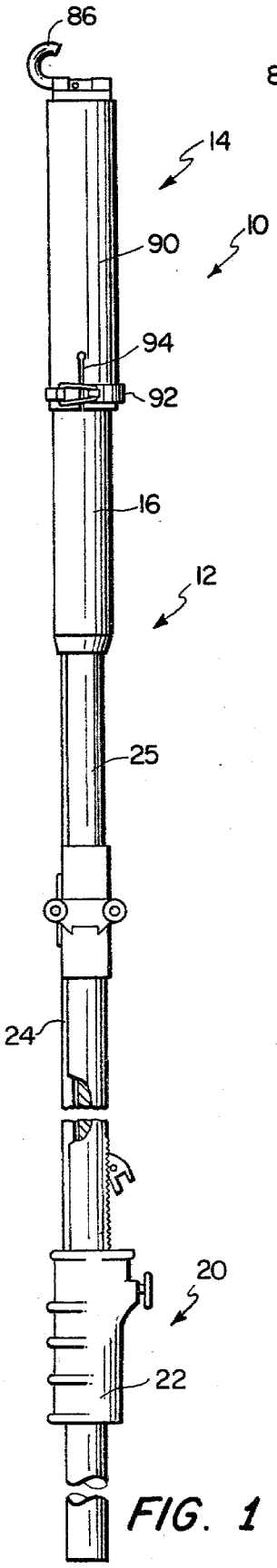
FIG. 1 is a fragmentary view with parts broken away for clarity of a torque-limiting clamp stick in accordance with the invention.

Turning now to the drawing, a torque-limiting clamp stick 10 is illustrated in FIG. 1. Stick 10 broadly includes an illustrative, conventional, axially rotatable clamp stick 12 and a removable torque-limiting adapter 14. The clamp stick 12 is of the type illustrated in U.S. Pat. No. 2,514,063, and includes an insulative tubular, upper section 16, a pivotal hook-type manipulative element 18 which is shiftable relative to the sections, and means broadly referred to by the numeral 20 for shiftably mounting the element 18 at least partially within section 16. Inasmuch as the structure and operation of the stick 12 is fully described and depicted in the referenced patent, a detailed discussion of such features is unnecessary except insofar as needed for a complete understanding of the present invention. To this end, it will be understood that the means 20 includes a shiftable handle 22, an elongated rod 24 which extends along the length of the body 25 of the clamp stick, and hook-supporting structure 26 for interconnecting the rod 24 and the element 18. In the normal use of the clamp stick 12, the element 8 is shifted upwardly as viewed in FIG. 1 until the element passes above the upper margin of the section 16. At this point a workpiece can be engaged and tightened. However, it will be appreciated that no torque-limiting function is present with the conventional clamp stick 12, and in fact the amount of torque applied is left strictly to guesswork.

It will also be understood that any one of a number of conventional clamp sticks can be used in the invention, and that the stick 12 simply illustrates one possible unit.

Figure 2:
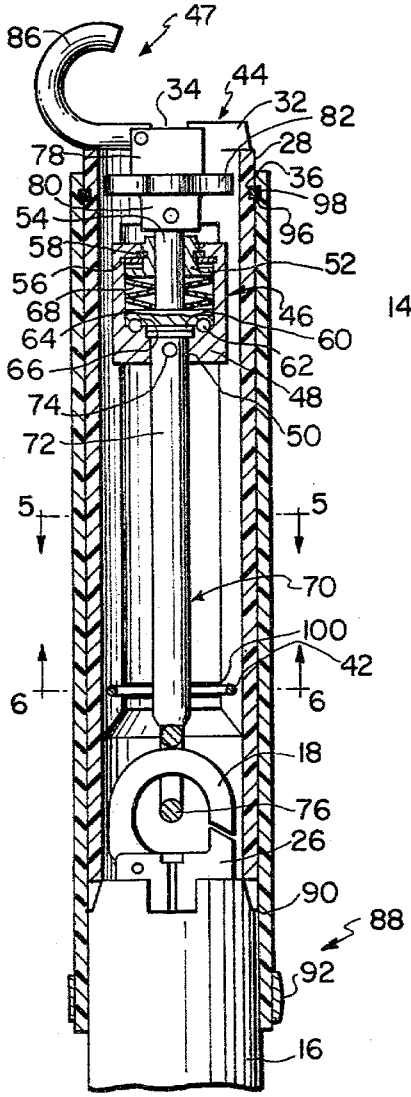
FIG. 2 is a vertical sectional view illustrating the adapter portion of the clamp stick depicted in FIG. 1.
Figure 3:
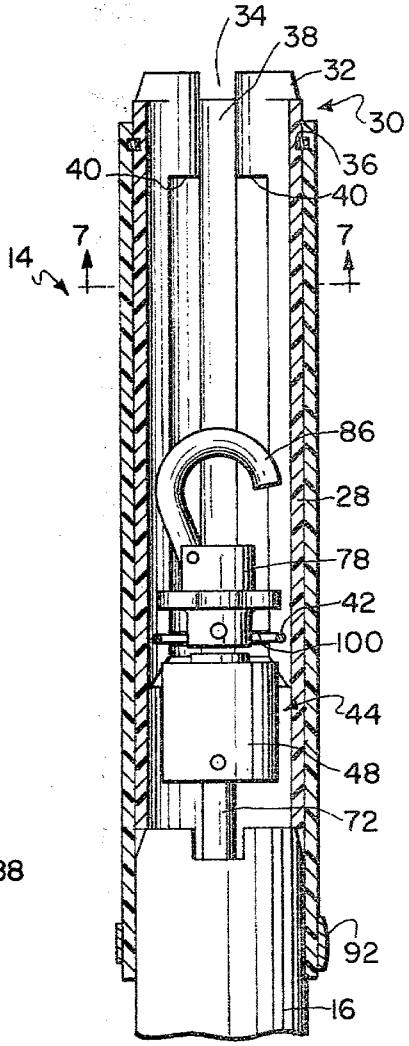
FIG. 3 is a view similar to that of FIG. 2, but showing the manipulative tool of the adapter in its recessed position within the adapter head.
Figure 6:
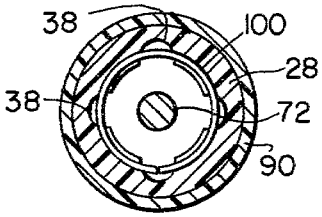
FIG. 6 is a sectional view taken along line 6—6 of FIG. 2.
Figure 7:
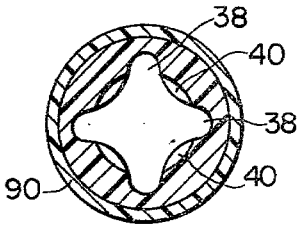
FIG. 7 is a sectional view taken along line 7—7 of FIG. 3.

Adapter 14 broadly includes an elongated, tubular, axially rotatable head 28 which is formed of insulative, synthetic resin material. The head 28 is configured to present an inwardly tapered uppermost margin 30 defined by four equally and circumferentially spaced projections 32 which cooperatively define corresponding recesses 34 about the periphery of the head. The outer wall of head 28 is configured to present an inwardly extending, circular ring-receiving slot 36 which extends completely around the head and is located a short distance below margin 30. Further, the inner wall of the head 28 is configured to present four equally spaced, elongated recesses or channels 38 which extend along the length of the head. The channels 38 are in alignment with the recesses 34 in the margin 30, and extend a substantial distance along the length of the head 28, as best seen in FIGS. 2 and 3. Four equally spaced, inwardly extending abutment shoulders 40 are respectively disposed between adjacent pairs of channels 38 (see FIG. 7), and the shoulders 40 are in alignment with the projections 32 and are located below the margin 30. Finally, the inner wall of the head 28 is provided with a circular, ring-receiving slot 42 which is important for purposes to be described.

An operating assembly broadly referred to by the numeral 44 is located at least partially within head 28 and includes a torque-limiting device 46, a manipulative tool 47, and means for operatively connecting the tool 47 to the element 18 of clamp stick 12 through the device 46.

In more detail, the torque-limiting device 46 is a patented, commercially available item sold by the X-4 Corporation of North Billerica, Massachusetts under the designation "Perf-A-Torq." The device 46 includes a rotatable, tubular housing 48 having a central, lowermost bore 50 therein. The upper end of the housing is closed by means of an adjustable nut 52 which surrounds a central, upwardly extending torque output shaft 54. The nut 52 is secured in a desired position by means of a locking plate 56 and a snap ring 58. The inner, lowermost end wall 60 of housing 48 is provided with a series of eight equally spaced, circumferentially arranged, seated balls 62. The inner end of shaft 54 is rigidly connected to a circular torque plate 64, and the latter is provided with eight circularly arranged, equally spaced ball-receiving detents 66 on the underside thereof. In the normal operation of device 46, the balls 62 seat within the detents 66. Finally, a plurality of leaf springs 68 are interposed between the upper surface of the plate 60 and the underside of nut 52.

In the operation of torque-limiting device 46, a torque applied to housing 48 (which serves as a torque input) is transferred through the balls 62 to plate 64 and thence to torque output shaft 54. When a preset maximum torque limit is reached however, continued application of input torque merely has the effect of rotating the housing 48 relative to the shaft 54 such that no torque is transmitted to the latter. In this mode the balls 62 shift circularly and reseat within successive detents 66, thus giving the user a pulsating indication that the torque level has been reached.

An elongated eye pin 70 is employed for interconnecting the housing of device 46 and the element 18. Specifically, the pin 70 includes an elongated shaft 72 which is inserted within the bore 50 and rigidly connected to housing 48 by means of roll pin 74, along with a circular eye 76 which surrounds and engages the hook element 18.

Figure 4:
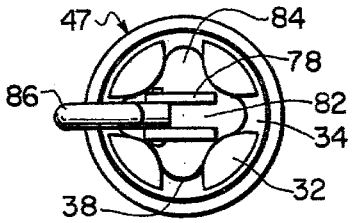
FIG. 4 is a plan view of the structure illustrated in FIG. 2.
Figure 5:
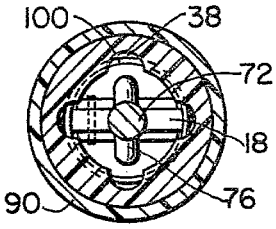
FIG. 5 is a sectional view taken along line 5—5 of FIG. 2.

The protruding end of torque output shaft 54 is fastened with a set screw to the tool 47. The latter includes a pair of upstanding mounts 78 and a lower boss portion 80 which receives the upper end of the shaft 54. Tool 47 further includes an integral, radially outwardly extending, head-engaging plate 82. As best seen in FIG. 4, the plate 82 is characterized by four equally and circumferentially spaced arcuate protuberances 84 which respectively nest within corresponding elongated channels 38 in the head. Finally, a hook 86 is secured between the mounts 78 and is pivotal about an axis transverse to the longitudinal axis of the head 28.

Securement means broadly referred to by the numeral 88 is provided for releasably and rotatably securing head 28 to the work end of clamp stick 12 and generally coaxially relative to the latter. The means 88 includes an elongated, tubular, outermost sleeve 90 of insulative material which surrounds the head 28. A releasable, band-type clamp assembly 92 is employed for fixedly securing the sleeve 90 onto the upper section 16 of clamp stick 12. The sleeve 90 is slotted as at 94 to facilitate initial positioning of the sleeve over the section 16, and a circular, ring-receiving slot 96 is formed in the inner wall of the sleeve adjacent the upper margin thereof.

In the completed construction of adapter 14, a locking ring 98 is seated within the slots 36 and 96 respectively formed in head 28 and sleeve 90. Thus, the head 28 can rotate relative to outer sleeve 90, but cannot shift longitudinally relative to the latter. Finally, a stop ring 100 is seated within the slot 42 and serves as a limit stop for the operating mechanism as will be described in detail hereinafter.

Adapter 14 may be mounted upon stick 12 by the following procedure. First, the manipulative element of the stick 12 is shifted to its free uppermost position, whereupon the element 18 flips open and is passed through the eye 76 of eye pin 70 and finally reclosed as illustrated in FIG. 2 to captively retain the eye 76. At this point the lower depending portion of the outer sleeve 90 is telescoped over the upper end of the section 16 until the lower end of the head 28 abuts the extreme upper margin of the section (see FIGS. 2 and 3). The clamp assembly 92 is next employed to lock the adapter in place onto the work end of the clamp stick 12. The composite, torque-limit clamp stick 10 is then ready for use.

In the use of the overall clamp stick 10, the tool 47 is first shifted by means of the operating mechanism of the original clamp stick 12 to the uppermost position of the tool, as seen in FIG. 2. As will be appreciated from the foregoing discussion of the construction of the overall apparatus 10, the protuberances 84 on the plate 82, and the corresponding channels 38, allow the tool 47, and for that matter the entire operating assembly 44, to shift longitudinally relative to head 28. In any event, the workpiece is then engaged by appropriate manipulation of hook 86, whereupon the entire clamp stick is shifted upwardly until the margin 30 of head 28 tightly engages the workpiece. Tightening of the workpiece is then accomplished by appropriate rotation of the original clamp stick 12. This in turn causes rotation of the eye bolt 70, housing 48, shaft 54, tool 47, and head 28 in unison. It will of course be realized that the plate 82 and corresponding recesses 38 ensure that the tool 47 and head 28 rotate together.

When the torque limit of the device 46 is reached, further rotation of eye pin 70 (in either a clockwise or counterclockwise direction) causes a slippage between the housing 48 and plate 64 in the manner described above. The end result of this is that the pin 70 and housing 48 rotate, but that no torque is transmitted to the output shaft 54. During this mode of operation, the tool 47 and head 28 are of course stationary.

After the proper tightening has been effected, it is only necessary to disengage hook 86 from the workpiece by appropriate manipulation of the stick. The operating assembly may then be pulled into a recessed position illustrated in FIG. 3. This involves simply employing the conventional operating mechanism of the clamp stick 12, whereupon the operating assembly 44 of the adapter is pulled to its recessed position. Here again, the protuberances 84 and corresponding channels 38 ensure smooth axial movement of the assembly into the head 28. In the latter regard, ring 100 serves as a lower stop for movement of the operating assembly, whereas the respective shoulders 40 serve as upper limits on the travel of the operating assembly.

If it is desired to reset the torque device 46 of adapter 14, the following steps are involved. First, the stop ring 100 is removed from the head 28 and the entire operating assembly 44 is pulled from the head 28. The tool 47 is next disconnected from output shaft 54, and the shaft 72 of eye bolt 70 is placed in a vise. The existing torque maximum of the device 46 is then obtained, preferably through the use of a direct reading memory torque wrench. The snap ring 58 is next removed, along with the locking plate 56. The nut 52 is then adjusted with a wrench, and a new torque reading is taken. This adjustment procedure is continued until a desired torque reading is obtained. The locking plate 56 and snap ring 58 are then replaced, tool 47 is reconnected to the shaft 54, the operating assembly is reinserted within the head 28, and stop ring 100 is reinstalled.

It will thus be appreciated that the present invention provides a torque-limiting clamp stick which retains all of the conventional and useful characteristics of conventional clamp sticks, while also giving an accurate, trouble-free means of limiting applied torque.

Having thus described the invention, what is claimed as new and desired to be secured by Letters Patent is:

1. An adapter for an elongated clamp stick having a manipulative element adjacent one end thereof which is axially rotatable at the desire of the user, said adapter comprising:

an elongated, tubular, axially rotatable head;

means for axially rotatably securing said head to said clamp stick adjacent said one end thereof and generally coaxially relative to the clamp stick;

an operating assembly located at least partially within said head including a torque limiting device presenting a torque input and a torque output, means for transmitting torque from said input to said output only up to a predetermined maximum torque limit, means for operatively connecting said device input to said element, a manipulative tool, and means for operatively connecting said device output and said tool; and means for coupling said tool to said head for axial rotation of the head and tool in unison before said torque limit is reached.

2. The adapter as set forth in claim 1 wherein said securing means comprises a sleeve disposed about said head, and means for mounting said sleeve onto said one end of the clamp stick.

3. The adapter as set forth in claim 1 wherein said element is axially shiftable relative to said clamp stick, said coupling means including means for coupling said tool to said head for relative axial shifting between the tool and head.

4. The adapter as set forth in claim 3 wherein said coupling means comprises a protuberance operatively secured to one of said head and tool, and structure defining an elongated, corresponding, complemental, protuberance-receiving channel in the other of said head and tool.

5. The adapter as set forth in claim 4 wherein said head includes said channel-defining structure, said channel extending along the length of the head.

6. The adapter as set forth in claim 1 wherein said means connecting said input to said element comprises an elongated eye pin.

7. The adapter as set forth in claim 1 wherein said tool comprises a hook, there being means pivotally supporting said hook for pivoting movement thereof about an axis generally transverse to the longitudinal axis of said head.

8. A clamp stick comprising:

an elongated body;

a manipulative tool; and means for mounting said tool adjacent one end of said body for axial rotation of the tool as desired, said mounting means comprising an elongated, tubular, axially rotatable head, means for axially rotatably securing said head to said body, an operating assembly at least partially located within said head including a torque limiting device presenting a torque input and a torque output, means operatively connecting said output to said tool, and means operatively connecting said device input to said body, said torque limiting device having means for transmitting torque from said input to said output only up to a predetermined maximum torque.

9. The clamp stick as set forth in claim 8, including means removably securing said tool and mounting means to said body.

10. The clamp stick as set forth in claim 8, including means coupling said tool to said head for axial rotation of the head and tool in unison until said predetermined maximum torque is reached.

11. The clamp stick as set forth in claim 10, there being means for relative axial shifting between said tool and said head, said coupling means including means for coupling said tool to said head for said axial shifting.

* * * * *